US011162324B2

(12) United States Patent
Al-Qasim et al.

(10) Patent No.: US 11,162,324 B2
(45) Date of Patent: Nov. 2, 2021

(54) SYSTEMS AND METHODS FOR ZONAL CEMENTING AND CENTRALIZATION USING WINGED CASING

(71) Applicant: Saudi Arabian Oil Company, Dhahran (SA)

(72) Inventors: Abdulaziz Al-Qasim, Dhahran (SA); Muataz Al-Ghamdi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 404 days.

(21) Appl. No.: 16/235,324

(22) Filed: Dec. 28, 2018

(65) Prior Publication Data

US 2020/0208495 A1 Jul. 2, 2020

(51) Int. Cl.

| | |
|---|---|
| ***E21B 33/14*** | (2006.01) |
| ***E21B 17/10*** | (2006.01) |
| ***E21B 34/06*** | (2006.01) |
| *E21B 33/12* | (2006.01) |

(52) U.S. Cl.

CPC ..... *E21B 33/14* (2013.01); *E21B 17/1078* (2013.01); *E21B 34/06* (2013.01); *E21B 33/12* (2013.01)

(58) Field of Classification Search

CPC ..... E21B 33/14; E21B 43/06
USPC ..... 166/285
See application file for complete search history.

(56) References Cited

U.S. PATENT DOCUMENTS

| | | | | |
|---|---|---|---|---|
| 3,527,297 A | | 9/1970 | Todd | |
| 3,570,603 A | | 3/1971 | Kammerer, Jr. et al. | |
| 3,623,550 A | | 11/1971 | De Lajarte et al. | |
| 4,825,947 A | * | 5/1989 | Mikolajczyk | E21B 47/01 166/241.1 |
| 6,622,792 B1 | | 9/2003 | Schick | |
| 7,086,479 B2 | | 8/2006 | Schultz et al. | |
| 7,527,095 B2 | | 5/2009 | Bloess et al. | |
| 7,690,437 B2 | * | 4/2010 | Guillot | E21B 33/1208 166/387 |

(Continued)

FOREIGN PATENT DOCUMENTS

WO 9222729 A1 12/1992

OTHER PUBLICATIONS

International Search Report and Written Opinion for related PCT application PCT/US2019/068520 dated Apr. 30, 2020.

*Primary Examiner* — Zakiya W Bates
*Assistant Examiner* — Ashish K Varma
(74) *Attorney, Agent, or Firm* — Bracewell LLP; Constance G. Rhebergen; Linda L. Morgan

(57) ABSTRACT

Systems and methods for cementing an annular space radially outward of a casing of a subterranean well include a float shoe located at a downhole end of the casing. A float valve is located within the float shoe and within a fluid flow path extending through the float shoe from an internal bore of the casing to an exterior surface of the float shoe. At least two wing members are located on an outer diameter surface of the casing, each of the wing members extending from the float shoe to an uphole end of the casing. The wing members are sized to define two or more separate sections of the annular space. A downhole splitter is located on a downhole surface of the float shoe. The downhole splitter is sized to seal between the downhole surface of the float shoe and an end surface of the subterranean well.

18 Claims, 4 Drawing Sheets

(56) References Cited

U.S. PATENT DOCUMENTS

| | | | | |
|---|---|---|---|---|
| 8,739,873 | B2 * | 6/2014 | Rogers | E21B 33/13 166/281 |
| 9,157,295 | B2 * | 10/2015 | Head | E21B 33/14 |
| 2012/0241154 | A1 * | 9/2012 | Zhou | E21B 34/12 166/285 |

* cited by examiner

SYSTEMS AND METHODS FOR ZONAL CEMENTING AND CENTRALIZATION USING WINGED CASING

BACKGROUND OF THE INVENTION

1. Field of the Invention

The present invention relates generally to casing for use in subterranean wells, and more specifically to casing for use in cementing operations within a subterranean well.

2. Description of the Related Art

When a subterranean well, such as a well used in hydrocarbon development, is drilled the subterranean well can be completed with tubulars or casings. The casing can be positioned within an open hole portion of the well and cemented in place. The composition of the cement can be optimized based on characteristics of the subterranean well and the formation through which the subterranean well extends. A poorly executed cementing operation can result in the need for a high cost remedial operation and can damage the life of the well.

SUMMARY OF THE DISCLOSURE

Embodiments of this disclosure provide systems and methods for both centralizing the casing with the wellbore and allowing for different types of cement slurries to be delivered to radial segments of the annular space between the casing and the wellbore.

In an embodiment of this disclosure, a system for cementing an annular space radially outward of a casing of a subterranean well includes a float shoe located at a downhole end of the casing. A float valve is located within the float shoe. The float valve is located within a fluid flow path extending through the float shoe from a bore of the casing to an exterior surface of the float shoe. At least two wing members are located on an outer diameter surface of the casing. Each of the at least two wing members extend from the float shoe to an uphole end of the casing. The at least two wing members are sized to define two or more separate sections of the annular space. A downhole splitter is located on a downhole surface of the float shoe. The downhole splitter is sized to seal between the downhole surface of the float shoe and an end surface of the subterranean well.

In alternate embodiments, an internal separator can extend axially within the bore of the casing and can extend from the float shoe to the uphole end of the casing. The internal separator can define two or more parallel separate flow paths within the bore of the casing. The float valve can include more than one float valve and each of the two or more parallel separate flow paths can be in fluid communication with one of the more than one float valve. Radially outward edges of the internal separator can sealingly engage an inner surface of the bore of the casing. Each of the two or more parallel separate flow paths can be in fluid communication with one of the two or more separate sections of the annular space. Each of the at least two wing members can include a seal member and a plurality of biasing members. The plurality of biasing members can bias the seal member in a radially outward direction. The seal member can be sized to extend from an outer surface of the casing to an inner surface of the subterranean well.

In an alternate embodiment of this disclosure, a system for cementing an annular space radially outward of a casing of a subterranean well includes the casing extending into the subterranean well defining the annular space between an outer diameter surface of the casing and an inner surface of the subterranean well. A float shoe is located at a downhole end of the casing. At least two wing members are located on the outer diameter surface of the casing. Each of the at least two wing members extend axially from the float shoe to an uphole end of the casing. The at least two wing members define two or more axially oriented separately sealed sections of the annular space. A downhole splitter is located on a downhole surface of the float shoe. The downhole splitter sealingly engages an end surface of the subterranean well and defines a bottom seal of each of the two or more axially oriented separately sealed sections of the annular space. A float valve is located within the float shoe. The float valve is located within a fluid flow path extending through the float shoe from a bore of the casing to an exterior surface of the float shoe. The float valve is a one way valve that is moveable from a closed position to an open position to allow fluid from within the bore of the casing to pass through the float shoe and into only one of the two or more axially oriented separately sealed sections of the annular space.

In alternate embodiments, the system can further include an internal separator extending axially within the bore of the casing and extending from the float shoe to the uphole end of the casing. The internal separator can define two or more parallel separate flow paths within the bore of the casing. The number of the two or more parallel separate flow paths within the bore of the casing can be equal to the number of the two or more axially oriented separately sealed sections of the annular space.

In other alternate embodiments, the float valve can include more than one float valve. One of the float valves can be located along a fluid flow path between each of the two or more parallel separate flow paths within the bore of the casing and the two or more axially oriented separately sealed sections of the annular space. Radially outward edges of the internal separator can sealingly engage an inner surface of the bore of the casing. Each of the two or more parallel separate flow paths within the bore of the casing can be in fluid communication with one of the two or more axially oriented separately sealed sections of the annular space. Each of the at least two wing members can include a seal member and a plurality of biasing members. The plurality of biasing members bias the seal member in a radially outward direction. The seal member can extend from an outer surface of the casing to the inner surface of the subterranean well.

In yet another alternate embodiment of this disclosure, a method for cementing an annular space radially outward of a casing of a subterranean well includes positioning a float shoe at a downhole end of the casing. A float valve is located within the float shoe. The float valve is located within a fluid flow path extending through the float shoe from a bore of the casing to an exterior surface of the float shoe. At least two wing members are positioned on an outer diameter surface of the casing. Each of the at least two wing members extend from the float shoe to an uphole end of the casing. The at least two wing members are sized to define two or more separate sections of the annular space. A downhole splitter is secured on a downhole surface of the float shoe. The downhole splitter is sized to seal between the downhole surface of the float shoe and an end surface of the subterranean well.

In alternate embodiments, the method can further include defining two or more parallel separate flow paths within the bore of the casing by providing an internal separator extending axially within the bore of the casing and extending from the float shoe to the uphole end of the casing. The float valve can include more than one float valve and the method can further include positioning one of the float valves in fluid communication with each of the two or more parallel separate flow paths.

In other alternate embodiments, the method further includes sealingly engaging an inner surface of the bore of the casing with radially outward edges of the internal separator. Each of the two or more parallel separate flow paths can be in fluid communication with one of the two or more separate sections of the annular space. Each of the at least two wing members can include a seal member. The seal member can be sized to extend from an outer surface of the casing to an inner surface of the subterranean well, and the method can further include biasing the seal member in a radially outward direction with a plurality of biasing members.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 2B:
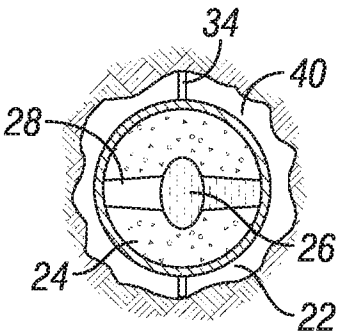
FIG. 2B is a cross section view of a float shoe of the system of FIG. 2A, shown with the second cement being pumped into the subterranean well.
Figure 2A:
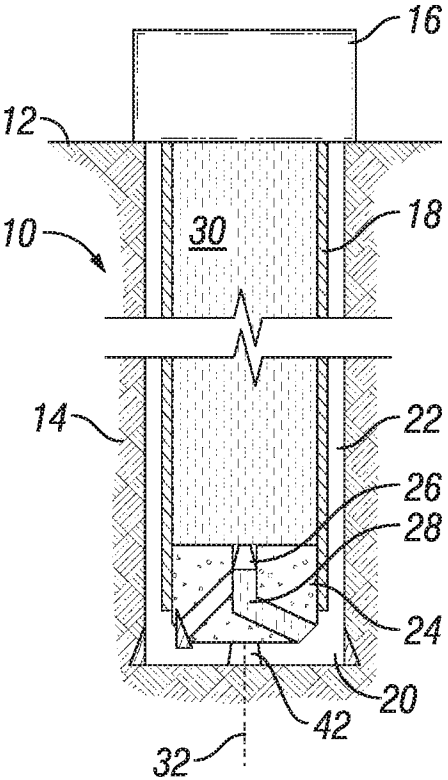
FIG. 2A is an elevation section view of a subterranean well with a system for cementing an annular space radially outward of a casing of the subterranean well, in accordance with an embodiment of this disclosure, shown with a second cement being pumped into the subterranean well.
Figure 1B:
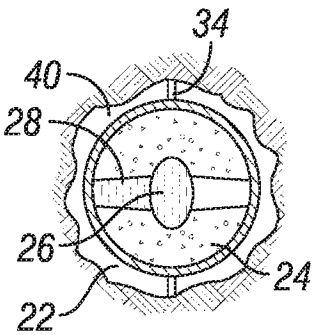
FIG. 1B is a cross section view of a float shoe of the system of FIG. 1A, shown with the first cement being pumped into the subterranean well.
Figure 1A:
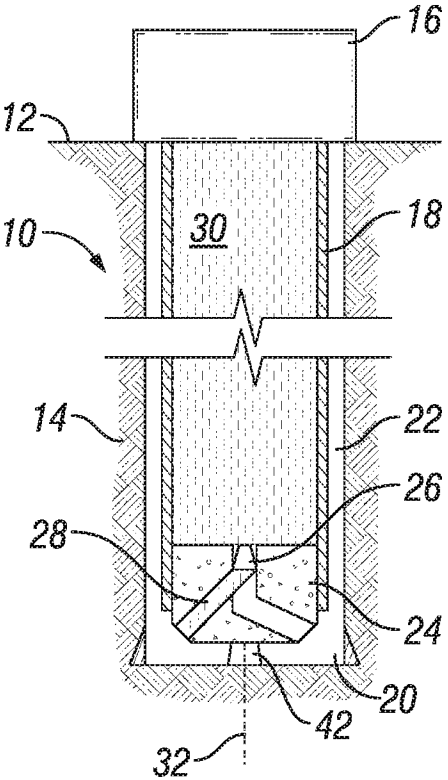
FIG. 1A is an elevation section view of a subterranean well with a system for cementing an annular space radially outward of a casing of the subterranean well, in accordance with an embodiment of this disclosure, shown with a first cement being pumped into the subterranean well.

Looking at FIGS. 1A and 2A, subterranean well 10 extends from a surface 12 into and through subterranean formation 14. Surface 12 can be, for example, an earth's surface or a sea bottom. Wellhead 16 is located as surface 12 at an uphole end of subterranean well 10. Casing 18 extends within wellbore 20. Annular space 22 is defined between an outer diameter surface of casing 18 and an inner surface of wellbore 20 of subterranean well 10.

Shown in FIGS. 1A and 2A is a system for cementing annular space 22 radially outward of casing 18. The system includes float shoe 24. Float shoe 24 is located at a downhole end of casing 18. Float shoe 24 can be used to guide casing 18 away from the inner surface of wellbore 20 as casing 18 is lowered into wellbore 20, reducing the risk that casing 18 is hung up on the inner surface of wellbore 20. Wellbore 20 of example embodiment of FIGS. 1A and 2A is a generally vertical wellbore 20. Wellbore 20 of example embodiment 3A includes a portion that is a generally horizontal wellbore 20. In other alternate embodiments, wellbore 20 can include portions that are generally vertical, portions that are generally horizontal, portions that are inclined at other angles from generally vertical, and can include combinations of one or more such portions.

Figures 3A, 3B:
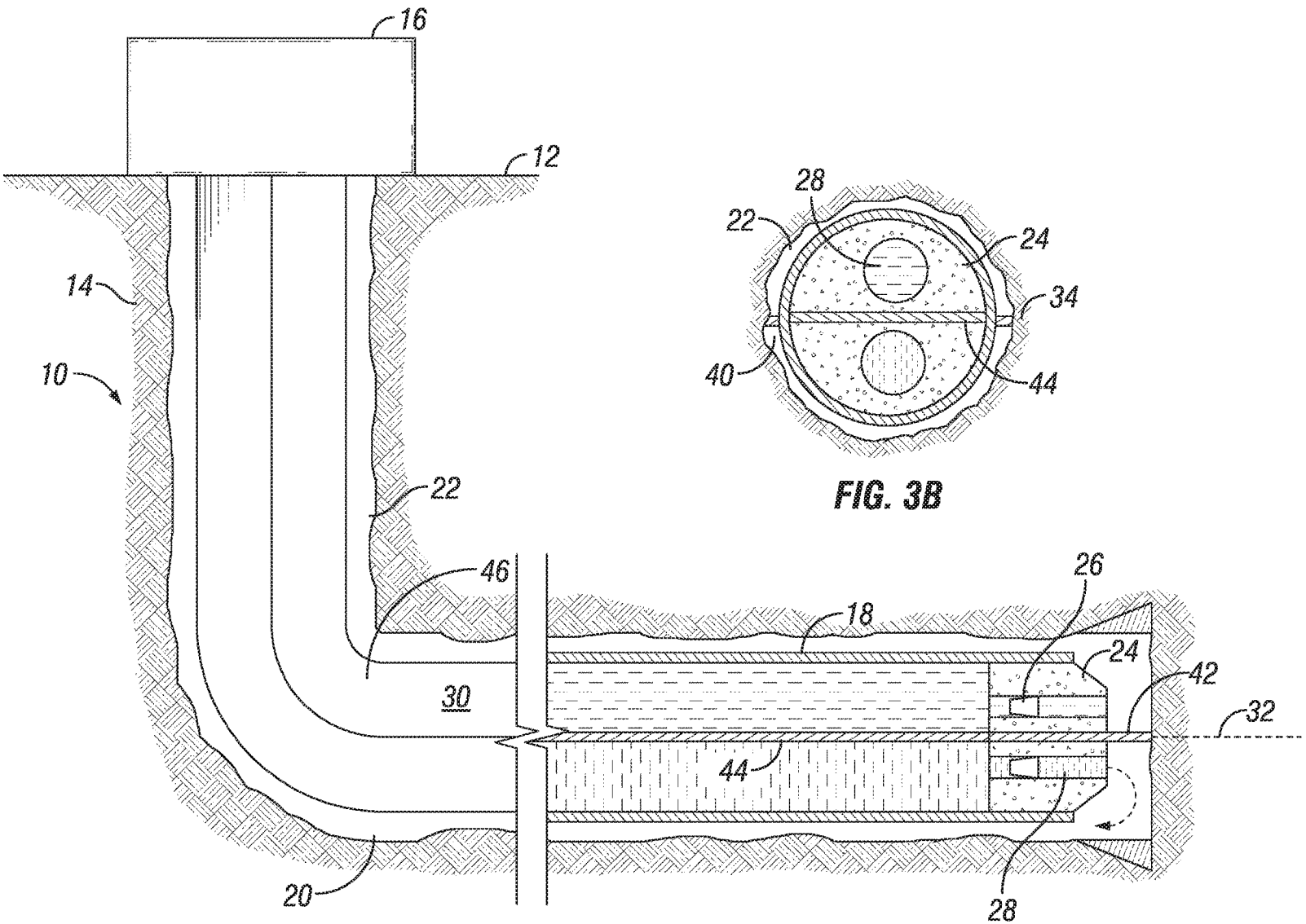
FIG. 3A is an elevation section view of a subterranean well with a system for cementing an annular space radially outward of a casing of the subterranean well, in accordance with an embodiment of this disclosure, shown after the first and second cement has been pumped into the subterranean well.
FIG. 3B is a cross section view of a float shoe of the system of FIG. 3A, shown after the first and second cement has been pumped into the subterranean well.

Looking at FIGS. 1A and 2A, float valve 26 is located within float shoe 24. Float valve 26 is further located within fluid flow path 28. Fluid flow path 28 extends through float shoe 24 from internal bore 30 of casing 18 to an exterior surface of float shoe 24. In the example of FIGS. 1A and 2A, fluid flow path 28 exits float shoe 24 at the exterior surface of float shoe 24 in a direction that is angularly offset from central axis 32. In other example embodiments, such as shown in FIG. 3A, fluid flow path 28 exits float shoe 24 at the exterior surface of float shoe 24 in a direction that is parallel to central axis 32.

Figure 4:
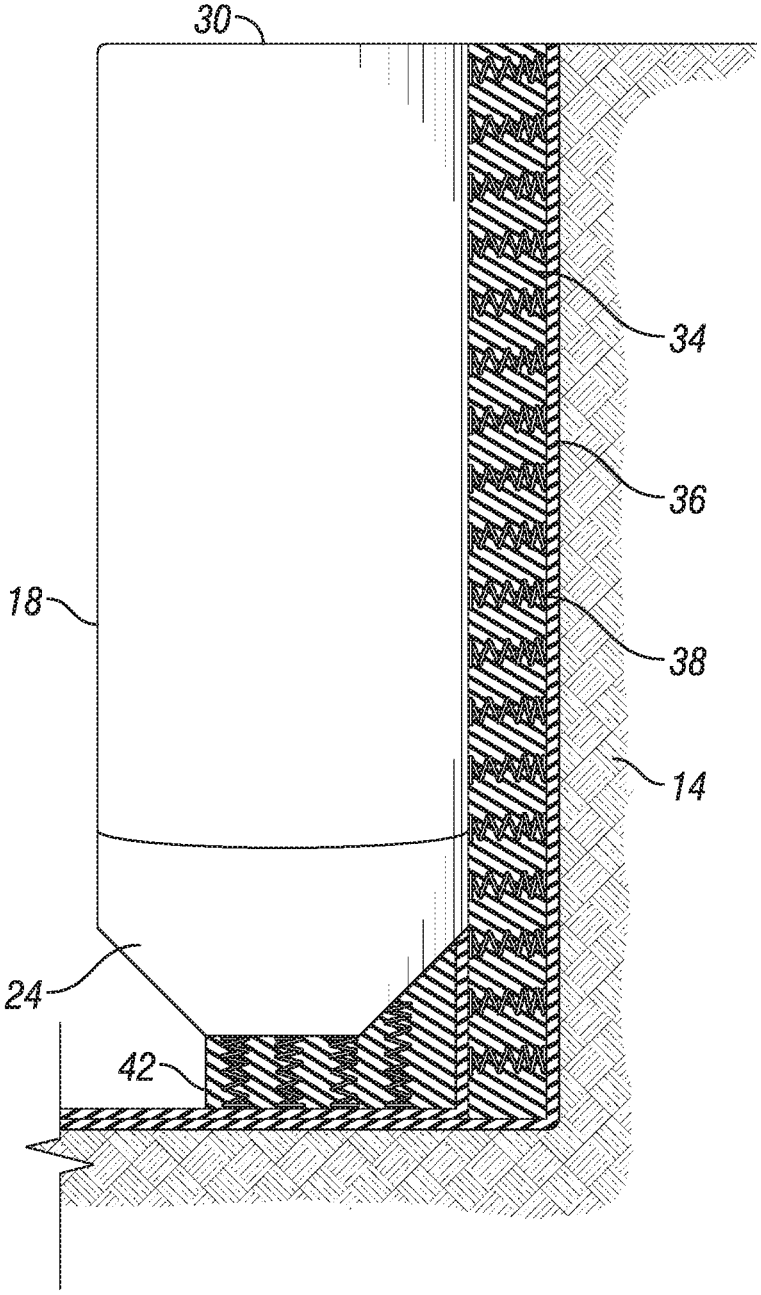
FIG. 4 is a detail section view of the casing and float shoe, in accordance with an embodiment of this disclosure.

Looking at FIGS. 1B and 2B, wing members 34 are located on the outer diameter surface of casing 18. Wing members 34 extend from float shoe 24 to an uphole end of casing 18. Looking at FIG. 4, each of wing member 34 includes seal member 36. Seal member 36 can be formed of, for example, rubber, or polymers. In alternate embodiments fibers formed of composite materials can be added to improve the strength and resistance of wing member 34 or seal member 36 to deterioration from the fluids within wellbore 20.

Seal member 36 extends from the outer surface of casing 18 to the inner surface of subterranean well 10. Seal member 36 can be a membrane with a thicker outer edge that sealingly engages the inner surface of wellbore 20 of subterranean well 10. Wing members 34 seal between casing 18 and the inner surface of wellbore 20 of subterranean well 10.

Wing members 34 further include and a plurality of biasing members 38. Biasing members 34 bias seal member 36 in a radially outward direction. Biasing member 34 can be, for example, springs or spring like members.

Wing members 34 are radially collapsible and sufficiently flexible so that as casing 18 is being delivered into wellbore 20, wing members 34 can bend and flex to move over and past abnormalities within wellbore 20, such as washouts and under gauged sections of wellbore 20. Wing members 34 are also sufficiently stiff to assist in the centralization of casing 18 within wellbore 20. Centralizing casing 18 within open wellbore 20 improves the cementing operation by providing a more uniform annular space around casing 18. The improved cementing operation also can result in improved zonal isolation and reduce the risk of a deteriorating cement integrity.

Figure 5A:
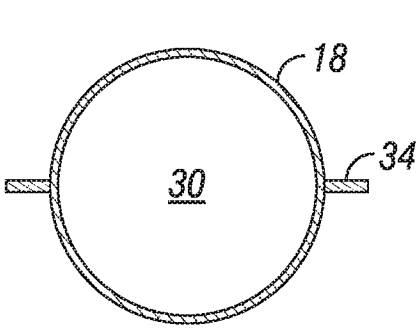
FIGS. 5A-5F are cross section views of the casing, in accordance with an embodiment of this disclosure.
Figure 5B:
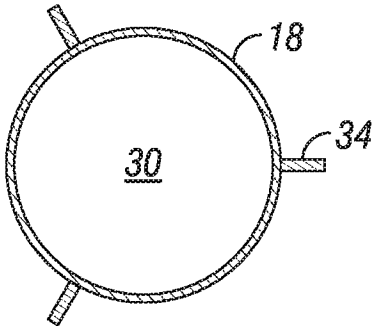
Figure 5C:
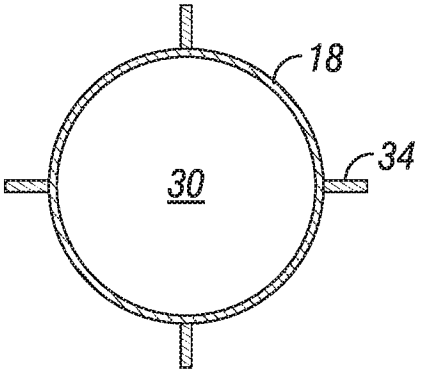

In the example embodiments of FIGS. 1B, 2B, and 3B of this disclosure there are at least two wing members 34 so that wing members 34 can define two or more separate sections 40 of annular space 22. In example embodiments of FIGS. 5A-5C, there are two, three, or four wing members 34. In alternate embodiments, there can be more than four wing members 34. Because wing members 34 form a seal between casing 18 and the inner surface of wellbore 20 of subterranean well 10, wing members 34 define two or more axially oriented separately sealed separate sections 40 of annular space 22.

Looking at FIGS. 1A and 2A, downhole splitter 42 is located on a downhole surface of float shoe 24. Downhole splitter 42 is sized to seal between the downhole surface of float shoe 24 and an end surface of wellbore 20 of subterranean well 10. An end of downhole splitter 42 sealingly engages an end surface of wellbore 20 of subterranean well 10. Downhole splitter 42 defines a bottom seal of each of the separate sections 40 of annular space 22.

Wing members 34 and downhole splitter 42 together form a sufficient seal that any cement injected into one of the separate sections 40 remain within such separate section 40 does not travel past any wing member 34 or enter an adjacent separate section 40. Looking at FIG. 4, in order to form a sufficient seal around a perimeter of each separate section 40, a portion of each downhole splitter 42 can overlap one of the wing members 34.

Looking at FIG. 3A, internal separator 44 extends axially within bore 30 of casing 18. Internal separator 44 extends from float shoe 24 to the uphole end of casing 18. Internal separator 44 defines two or more parallel separate flow paths 46 within bore 30 of casing 18. Radially outward edges of vanes 48 of internal separator 44 sealingly engage an inner surface of bore 30 of casing 18. Internal separator 44 is a tool that can be moved into casing 18 during cementing operations and removed from casing 18 at the completion of cementing operations. Internal separator 44 can have a shape that aligns with downhole splitter 42.

Figure 5D:
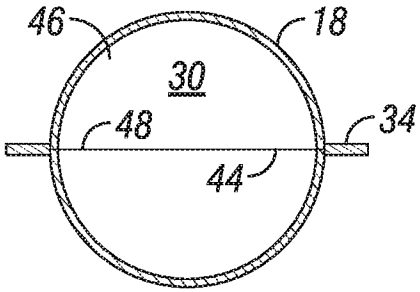
Figure 5E:
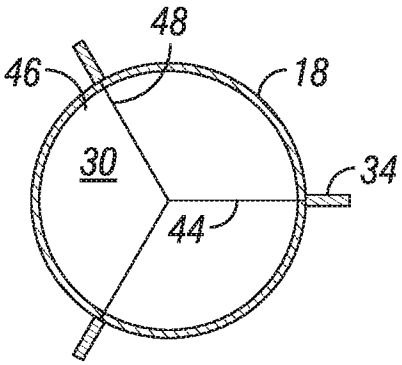
Figure 5F:
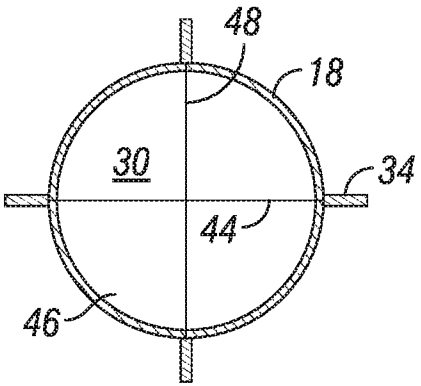

The arrangement of internal separator 44 can be such that each of the two or more parallel separate flow paths 46 is in fluid communication with one of the two or more separate sections 40 of the annular space 22. Looking at FIGS. 5D-5F, the number of radially outward edges of vanes 48 of internal separator 44 is equal to the number of wing members 34 and radially outward edges of vanes 48 align with wing members 34.

Looking at FIG. 3A, float shoe 24 can direct pumped cement from a separate flow paths 46 into a in a certain direction in separate section 40 of the annular space 22. Each of the separate flow paths 46 is in fluid communication with a separate section 40 of the annular space 22 by way of float valve 26. Float valve 26 can be a one way valve that is moveable from a closed position to an open position to allow fluid from within bore 30 of casing 18 to pass through float shoe 24 and into only one of two or more axially oriented separately sealed sections 40 of annular space 22.

In an example of operation in order to cement annular space 22 radially outward of casing 18, casing 18 can be located within wellbore 20. Wing members 34 and downhole splitter 42 provide a sufficient seal with an inner surface of subterranean well 10 so that two or more separately sealed separate sections 40 are formed within annular space 22. Float valve 26 within float shoe 24 is located along fluid flow path 28, which directs fluid from within the bore of casing 18 into annular space 22. Float valve 26 can provide for the flow of fluid in a single direction. Cement pumped into the bore of casing 18 can therefore be directed in a separate section 40 as desired by reservoir and subterranean well 10 conditions.

Therefore, as disclosed herein, embodiments of the systems and methods of this disclosure provide a casing system for allowing for zonal cementing operations. The casing string is equipped with collapsible wings that can be used for isolation of axially oriented cementing zones and centralize the casing for improved cement bond. The proposed system splits the open hole-casing annulus from the downhole casing point depth to the surface, providing segmented flow paths for fluids and cement to move. Embodiments of this disclosure allow for the option to pump multiple separate cement slurries in axially isolated portions of the hole.

In certain embodiments, the casing methods and systems allow for simultaneous cementing of multiple compartments where the separation is aided by an internal tool that is run inside the casing for compartmentalizing the inner bore of the casing. In such an embodiment, different cement compositions can be pumped into separate axially oriented compartments.

Embodiments of the disclosure described herein, therefore, are well adapted to carry out the objects and attain the ends and advantages mentioned, as well as others inherent therein. While embodiments of the disclosure has been given for purposes of disclosure, numerous changes exist in the details of procedures for accomplishing the desired results. These and other similar modifications will readily suggest themselves to those skilled in the art, and are intended to be encompassed within the present disclosure and the scope of the appended claims.

What is claimed is:

1. A system for cementing an annular space radially outward of a casing of a subterranean well, the system including:

a float shoe located at a downhole end of the casing;

a float valve located within the float shoe, the float valve located within a fluid flow path extending through the float shoe from a bore of the casing to an exterior surface of the float shoe;

at least two wing members located on an outer diameter surface of the casing, each of the at least two wing members extending from the float shoe to an uphole end of the casing, the at least two wing members sized to define two or more separately sealed sections of the annular space radially outward of the casing; and a downhole splitter located on a downhole surface of the float shoe, the downhole splitter sized to seal between the downhole surface of the float shoe and a terminal end surface of the subterranean well, by engaging the terminal end surface of the subterranean well.

2. The system of claim 1, further including an internal separator extending axially within the bore of the casing and extending from the float shoe to the uphole end of the casing, the internal separator defining two or more parallel separate flow paths within the bore of the casing.

3. The system of claim 2, where the float valve includes more than one float valve and where each of the two or more parallel separate flow paths is in fluid communication with one of the more than one float valve.

4. The system of claim 2, where radially outward edges of the internal separator sealingly engage an inner surface of the bore of the casing.

5. The system of claim 2, where each of the two or more parallel separate flow paths is in fluid communication with one of the two or more separately sealed sections of the annular space.

6. The system of claim 1, where each of the at least two wing members includes a seal member and a plurality of biasing members, the plurality of biasing members biasing the seal member in a radially outward direction, where the seal member is sized to extend from an outer surface of the casing to an inner surface of the subterranean well.

7. A system for cementing an annular space radially outward of a casing of a subterranean well, the system including:

the casing extending into the subterranean well defining the annular space between an outer diameter surface of the casing and an inner surface of the subterranean well;

a float shoe located at a downhole end of the casing;

at least two wing members located on the outer diameter surface of the casing, each of the at least two wing members extending axially from the float shoe to an uphole end of the casing, the at least two wing members defining two or more axially oriented separately sealed sections of the annular space radially outward of the casing;

a downhole splitter located on a downhole surface of the float shoe, the downhole splitter sealingly engaging a terminal end surface of the subterranean well by engaging the terminal end surface of the subterranean well, and defining a bottom seal of each of the two or more axially oriented separately sealed sections of the annular space; and a float valve located within the float shoe, the float valve located within a fluid flow path extending through the float shoe from a bore of the casing to an exterior surface of the float shoe; wherein the float valve is a one way valve that is moveable from a closed position to an open position to allow fluid from within the bore of the casing to pass through the float shoe and into only one of the two or more axially oriented separately sealed sections of the annular space.

8. The system of claim 7, further including an internal separator extending axially within the bore of the casing and extending from the float shoe to the uphole end of the casing, the internal separator defining two or more parallel separate flow paths within the bore of the casing, and wherein the number of the two or more parallel separate flow paths within the bore of the casing is equal to the number of the two or more axially oriented separately sealed sections of the annular space.

9. The system of claim 8, where the float valve includes more than one float valve and where one of the more than one float valve is located along a fluid flow path between each of the two or more parallel separate flow paths within the bore of the casing and the two or more axially oriented separately sealed sections of the annular space.

10. The system of claim 8, where radially outward edges of the internal separator sealingly engage an inner surface of the bore of the casing.

11. The system of claim 8, where each of the two or more parallel separate flow paths within the bore of the casing is in fluid communication with one of the two or more axially oriented separately sealed sections of the annular space.

12. The system of claim 7, where each of the at least two wing members includes a seal member and a plurality of biasing members, the plurality of biasing members biasing the seal member in a radially outward direction, where the seal member extends from an outer surface of the casing to the inner surface of the subterranean well.

13. A method for cementing an annular space radially outward of a casing of a subterranean well, the method including:

positioning a float shoe at a downhole end of the casing;

locating a float valve located within the float shoe, the float valve located within a fluid flow path extending through the float shoe from a bore of the casing to an exterior surface of the float shoe;

positioning at least two wing members on an outer diameter surface of the casing, each of the at least two wing members extending from the float shoe to an uphole end of the casing, the at least two wing members sized to define two or more separately sealed sections of the annular space radially outward of the casing; and securing a downhole splitter on a downhole surface of the float shoe, the downhole splitter sized to seal between the downhole surface of the float shoe and a terminal end surface of the subterranean well, by engaging the terminal end surface of the subterranean well.

14. The method of claim 13, further including defining two or more parallel separate flow paths within the bore of the casing by providing an internal separator extending axially within the bore of the casing and extending from the float shoe to the uphole end of the casing.

15. The method of claim 14, where the float valve includes more than one float valve and where the method further includes positioning one of the more than one float valve in fluid communication with each of the two or more parallel separate flow paths.

16. The method of claim 14, further including sealingly engaging an inner surface of the bore of the casing with radially outward edges of the internal separator.

17. The method of claim 14, where each of the two or more parallel separate flow paths is in fluid communication with one of the two or more separately sealed sections of the annular space.

18. The method of claim 13, where each of the at least two wing members includes a seal member, where the seal member is sized to extend from an outer surface of the casing to an inner surface of the subterranean well, and the method further includes biasing the seal member in a radially outward direction with a plurality of biasing members.

* * * * *